US008471655B2

(12) United States Patent
Woodson et al.

(10) Patent No.: US 8,471,655 B2
(45) Date of Patent: Jun. 25, 2013

(54) PISTON TRIP RESET LEVER

(75) Inventors: Cameron Woodson, Cedar Rapids, IA (US); Rodney Powell, Cedar Rapids, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 206 days.

(21) Appl. No.: 12/985,104

(22) Filed: Jan. 5, 2011

(65) Prior Publication Data

US 2012/0168292 A1 Jul. 5, 2012

(51) Int. Cl.
*H01H 73/00* (2006.01)

(52) U.S. Cl.
USPC ..... 335/26; 335/6

(58) Field of Classification Search
USPC ..... 335/26, 34, 6
See application file for complete search history.

(56) References Cited

U.S. PATENT DOCUMENTS 4,617,545 A * 10/1986 Link ..... 337/74
5,103,198 A 4/1992 Morel et al.
5,298,874 A * 3/1994 Morel et al. ..... 335/8
6,369,340 B1 * 4/2002 Castonguay et al. ..... 200/244
6,373,357 B1 4/2002 Douville et al.
6,542,057 B2 4/2003 Douville et al.
6,919,785 B2 7/2005 Douville et al.
6,995,640 B2 2/2006 Harmon et al.
2004/0239458 A1 12/2004 Harmon et al.
2009/0179011 A1 * 7/2009 Asokan et al. ..... 218/157

OTHER PUBLICATIONS

International Search Report for International Application No. PCT/US2011/065320, dated Mar. 28, 2012, 3 pages.
Written Opinion for International Application No. PCT/US2011/065320, dated Mar. 28, 2012, 5 pages.

* cited by examiner

*Primary Examiner* — Lincoln Donovan
*Assistant Examiner* — Lisa Homza
(74) *Attorney, Agent, or Firm* — Nixon Peabody LLP

(57) ABSTRACT

A device for transferring motion from a manual lever to a reset lever of a pressure trip mechanism in a molded case circuit breaker. The pressure trip mechanism is activated when hot gasses are released during an arc event and the resultant increase in pressure forces a piston in the mechanism to expand and thereby activate the breaker. In some interruption events, hot gasses, and occasionally fragments of molten metal, are responsible for marring the plastic piston surface of the pressure trip mechanism and prevent the mechanism from returning to its pre-interruption position even when it is biased to the pre-interruption position with a spring. A configuration disclosed herein provides for linking the motion of the hand-driven manual lever used to reset the breaker to the reset lever connected to the pressure trip mechanism in order to force the pressure trip mechanism to return to its pre-interruption position.

17 Claims, 11 Drawing Sheets

PISTON TRIP RESET LEVER

FIELD OF THE INVENTION

The present disclosure relates generally to resetting a circuit breaker following a trip event, and, more particularly, to a mechanism for resetting a reset lever in pressure trip molded case circuit breaker following a trip event that fouls an internal surface of the breaker.

BACKGROUND

A molded case circuit breaker (MCCB) can incorporate a pressure sensitive trip mechanism, sometimes called a piston trip, to detect over current events and trip the breaker. Internal to the MCCB, a chamber houses two electrical contacts that are configured to separate due to electrodynamic forces generated when the current flowing through the contacts is excessively high. When the contacts separate, an arc occurs as the air between the contacts ionizes and electrical energy arcs between the contacts. The energy released during the arc heats the gas in the chamber and increases the pressure within the chamber. The chamber housing the contacts is sometimes referred to as a breaking unit. The breaking unit is in fluid communication with a piston trip pressure sensitive unit, which is another chamber that includes a movable surface that moves in response to the pressure increase communicated from the breaking unit. In some breakers, the movable surface is a piston moving within a cylinder. In others, the movable surface is one side of a lever that pivots when the pressure increases. The movement of the movable surface then activates a trip mechanism through a mechanical linkage. The trip mechanism can be configured to break multiple poles of an electrical circuit simultaneously. Such an MCCB generally incorporates exhaust vents for venting the high pressure gas following the activation of the trip mechanism.

An MCCB incorporating a pressure sensitive trip mechanism (also referred to as a piston trip module) generally incorporates a bias for biasing the movable surface in a normal operating position. A piston trip module incorporating a bias is disclosed in U.S. Pat. No. 5,298,874 to Morel et al. A spring can be used to bias the movable surface. During the arc, the movable surface moves against the force of the bias to activate the trip mechanism due to the high pressure created by the heated gas. Once the trip mechanism is activated, the arc halts. With the gasses no longer heated, the pressure in the breaking unit returns to normal. The return of normal pressure may be assisted by venting the heated gas into exhaust vents. After the pressure has stabilized, the bias causes the movable surface to return to the normal operating position.

Occasionally, however, the interior surface that the movable surface moves along is damaged during the arc fault event by hot gasses and molten metallic debris generated during the arc. Hot gasses and debris can become imbedded in the interior surface or otherwise foul the interior surface. The damage to the interior surface can impede the movement of the movable surface as it is returned to its normal operating position under the force of the bias. When the force of the bias is unable to return the movable surface to its normal operating position due to the fouled interior surface, the MCCB may trip while operating.

BRIEF SUMMARY

Provided herein is an apparatus for resetting a piston trip incorporated in an electrical circuit breaker. The apparatus provides for transferring motion from a manual reset lever, also called a breaker handle, of the electrical circuit breaker to a reset lever of the piston trip. The breaker handle can be a hand-driven lever of the electrical circuit breaker that is used to reset a trip mechanism within the breaker following a trip event. The reset lever of the piston trip can be a component mechanically linked to a movable surface within the piston trip. A mechanical coupling is achieved between the breaker handle and the movable surface through the use of a connecting element. The connecting element links the motion of the breaker handle to the motion of the movable surface. During a reset operation of the electrical circuit breaker, the breaker handle is moved to an off position. Moving the breaker handle to the off position causes a component mechanically linked to the breaker handle to push against the connecting element and the connecting element to push against the component mechanically linked to the movable surface.

According to a configuration of the present disclosure, the connecting element can be a lever generally shaped like a wedge that is configured to rotate about a pivot. The lever can have a first surface that contacts the component mechanically linked to the breaker handle. The lever can have a second surface that contacts the component mechanically linked to the movable surface. Additionally, the connecting element can have a first and second nodule useful for retaining the connecting element in a desirable position and for ensuring that the connecting element is placed in its correct position during an assembly operation of the electrical circuit breaker. An electrical circuit breaker utilizing the connecting element disclosed herein to mechanically link the motion of the breaker handle to the motion of the movable surface can advantageously avoid tripping while operating. The connecting element ensures that the movable surface is properly returned to its reset position following a trip event.

The foregoing and additional aspects and implementations of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

DETAILED DESCRIPTION

FIGS. 1A through 1E provide a series of functional block diagrams symbolically illustrating a piston trip in different operating states. The piston trip illustrated can be incorporated into an electrical circuit breaker, such as a molded case circuit breaker (MCCB). The piston trip can be used to detect over current events and activate a trip mechanism. The functional block diagrams shown in FIGS. 1A through 1E illustrate aspects of the piston trip useful for understanding the operation of a mechanical linkage disclosed herein. The mechanical linkage resets the piston trip by providing a connection between the motion of a manual reset handle of the electrical circuit breaker to the reset of the piston trip. Aspects of the present disclosure provide for a connecting element for linking the motion of the manual reset handle to the motion of a movable surface within the piston trip.

Figure 1B:
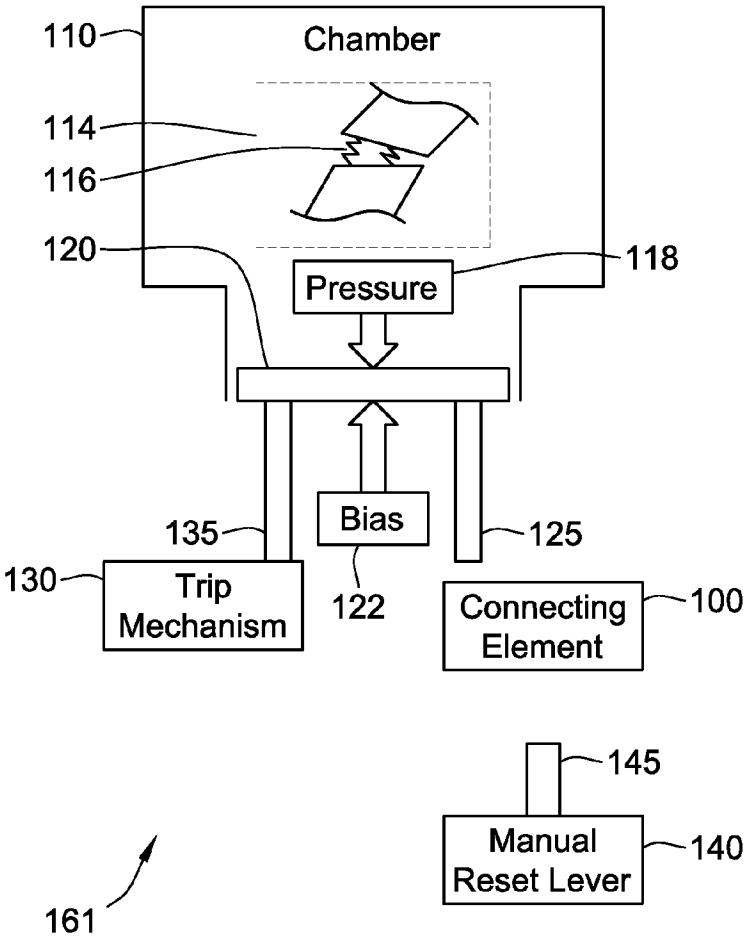
FIG. 1B is a block diagram showing the piston trip during an over current event.
Figure 1A:
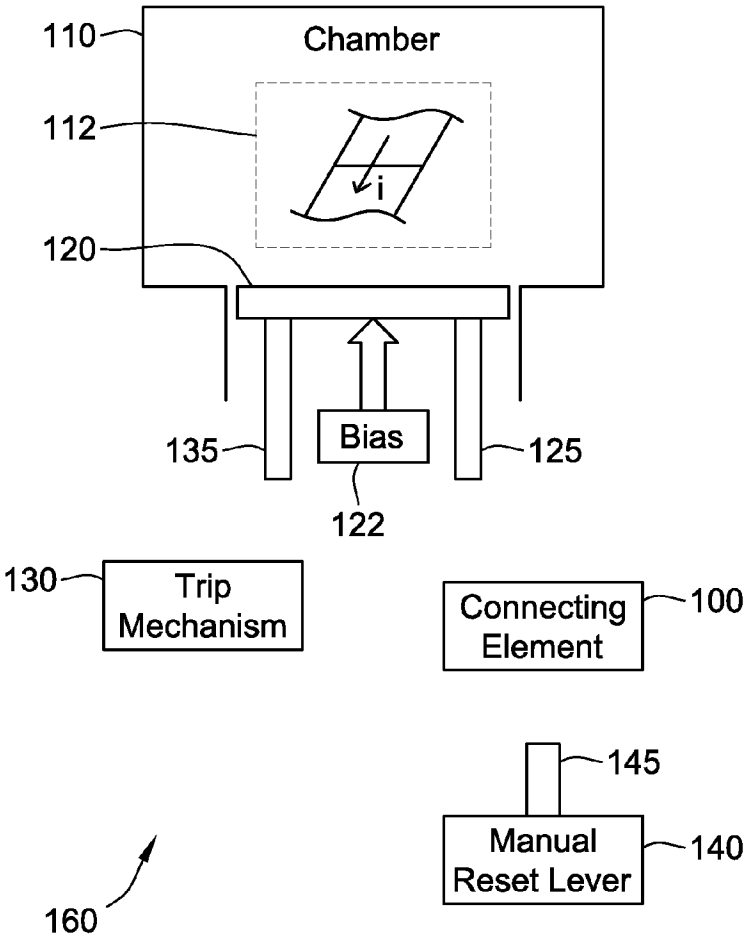
FIG. 1A is a block diagram showing the piston trip in a normal operating state.

FIG. 1A is a functional block diagram 160 showing the piston trip in a normal operating state. It should be noted that the functional block diagram 160 is not intended to illustrate all of the mechanical interrelationships among the illustrated components, but does illustrate symbolically the functional interactions among the components. The functional block diagram 160 includes a pair of electrical contacts 112 within a chamber 110. Alternatively, the pair of electrical contacts 112 can be housed within another chamber in fluid communication with the chamber 110. A portion of the interior boundary of the chamber 110 is defined by a movable surface 120. The movable surface 120 can be a piston driven through a sheath or can be a portion of a lever. The movable surface is shown in a first position and is maintained in the first position by a bias 122. The bias 122 applies a force to the movable surface 120 opposing its direction of motion. The bias 122 can be provided by a spring. The pair of electrical contacts 112 make electrical contact and a current flows through the pair of electrical contacts 112. The pair of electrical contacts are configured to separate in response to the current flowing through them exceeding a threshold according to any method appreciated by those skilled in the art of electrical circuit breakers. For example, the pair of electrical contacts can separate due to an electrodynamic force created by the excessive current or due to thermal heating created by the excessive current causing a bimetallic strip to deflect.

The functional block diagram 160 includes a trip mechanism 130. The trip mechanism 130 is activated by a trip component 135 mechanically linked to the movable surface 120. The trip mechanism 130 can be a latch that is activated by making contact with the trip component 135. The trip component 135 can be a rod, a lever, or any other part suitable for providing a mechanical link between the trip mechanism 130 and the movable surface 120. The trip component 135 can be permanently affixed to the movable surface 120, and can be integrally formed with the movable surface 120. The functional block diagram 160 further includes a breaker handle 140 and a first component 145 mechanically linked to the breaker handle 140. The first component 145 can be permanently connected to the breaker handle 140 or can be positioned such that a movement of the breaker handle 140 causes a part permanently affixed to the breaker handle 140 to contact the first component 145. Additionally or alternatively, the first component 145 can be linked to the breaker handle 140 through a mechanical connection including a rod or a lever.

The functional block diagram 160 further includes a connecting element 100 for linking the motion of the breaker handle 140 to the movable surface 120. The connecting element 100 can be a rod or a lever which provides a mechanical coupling between the first component 145 mechanically linked to the breaker handle 140 and a second component 125 mechanically linked to the movable surface 120. In a configuration, the trip component 135 can be implemented as the same part as the second component 125, so long as the part provides a mechanical connection between the movable surface 120 and the trip mechanism 130, and the movable surface 120 and the connecting element 100.

During operation of the piston trip in a normal operating state illustrated by the functional block diagram 160, current flows through the pair of electrical contacts 112. The current does not exceed a threshold and the contacts do not separate. Because the contacts do not separate, an arcing event does not occur, and a pressure is not generated within the chamber. Because a pressure is not generated to oppose the force of the bias 122, the movable surface 120 remains in the first position shown and the trip component 135 is not moved to activate the tripping mechanism 130.

FIG. 1B is a functional block diagram 161 showing the piston trip during an over current event. The functional block diagram 161 is similar to the functional block diagram 160 shown in FIG. 1A, except that the diagram includes a separated pair of electrical contacts 114. Just before separating, the separated pair of electrical contacts 114 conducted a current flowing through them. The separated pair of electrical contacts 114 separated because the current flowing through them exceeded the threshold. Shortly after separation, a voltage difference exists between the separated pair of electrical contacts 114. The voltage difference between the separated electrical contacts 114 can cause the gasses between the separated electrical contacts 114 to ionize, and the process can release the arcing energy 116. The release of the arcing energy 116 within the chamber 110 heats the gasses within the chamber 110 and increases the temperature and pressure 118 within the chamber 110. The pressure 118 applies a force to the movable surface 120 and causes the movable surface 120 to move against the force of the bias 122 to a second position.

The movable surface 120 is shown in the second position in the block diagram 161. The chamber 110 has a larger volume when the movable surface 120 is in the second position than when the movable surface 120 is in the first position. Similarly, the chamber 110 has a smaller volume when the movable surface 120 is in the first position than when the movable surface 120 is in the second position. Said another way, the volume of the chamber 110 is larger responsive to the movable surface 120 being in the second position than responsive to the movable surface 120 being in the first position. As a result of the movement of the movable surface 120, the trip component 135 mechanically linked to the movable surface 120 activates the trip mechanism 130. The activation of the trip mechanism 130 causes current to stop flowing to the separated pair of electrical contacts 114, and thereby halts the release of the arcing energy 116. While the functional block diagram 161 illustrates a single pair of separated electrical contacts 114, the activation of the trip mechanism 130 can trip all poles of a multipole breaker to halt current flowing to multiple poles simultaneously. Once the arcing energy 116 is no longer being released, the increased pressure 118 and temperature within the chamber 110 dissipate and the movable surface 120 returns to the first position under the influence of the bias 122.

Figure 1D:
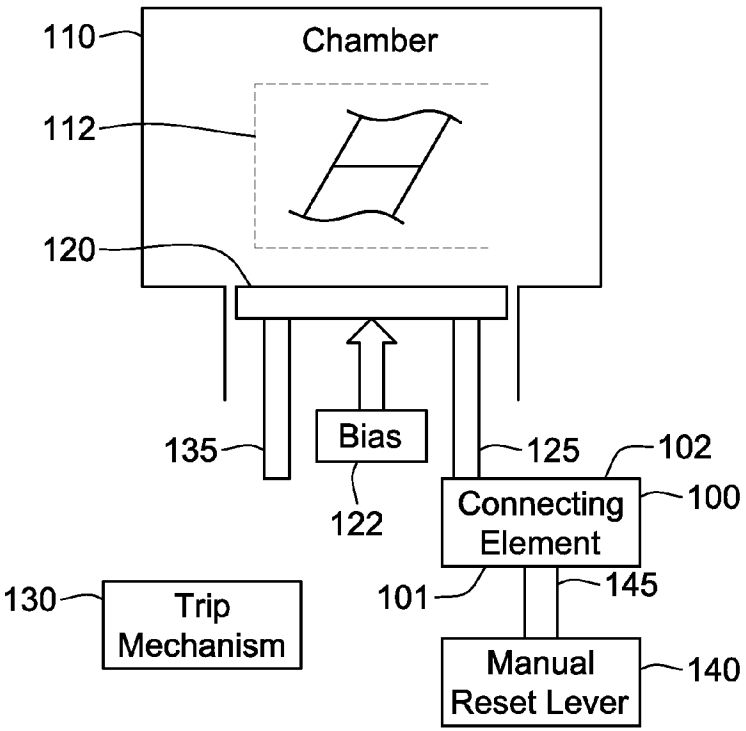
FIG. 1D is a block diagram showing the piston trip being reset through the use of the connecting element.
Figure 1C:
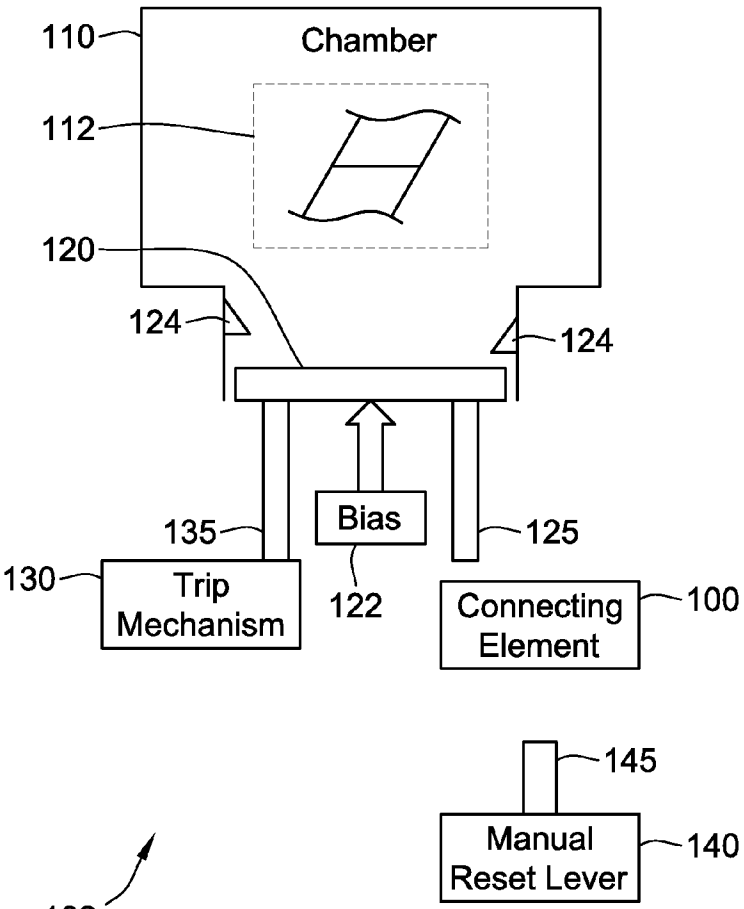
FIG. 1C is a block diagram showing the piston trip which will trip while operating unless it is forcibly reset.

FIG. 1C is a functional block diagram 162 showing the piston trip that will trip while operating unless it is forcibly reset. The functional block diagram 162 shows a piston trip following an arcing event where debris or hot gasses generated during the arcing event damaged an interior surface of the chamber so as to prevent the movable surface 120 from returning to the first position. In the functional block diagram 162, the damage to the interior surface is due to imbedded debris 124. For example, the impeded debris 124 can be debris from molten metal fragments becoming imbedded in the interior surface of the chamber 110. The imbedded debris 124 impedes the movement of the movable surface 120 and prevents the movable surface 120 from returning to the first position. The movable surface 120 is prevented from returning to the first position even after the increased pressure within the chamber 110 dissipates and the bias 122 urges the movable surface 120 toward the first position. By impeding the movement of the movable surface 120, the trip mechanism 130 continues to be activated by the trip component 135 mechanically linked to the movable surface 120.

An energized electrical circuit breaker incorporating the piston trip shown in the functional block diagram 162 trips while operating unless the movable surface 120 is forced back to the first position. The connecting element 100 enables the movable surface to be returned to the first position and thereby avoid problems associated with tripping while operating. The connecting element 100 provides a mechanical connection between the first component 145 mechanically linked to the breaker handle and the second component 125 mechanically linked to the movable surface 120. The operation of the connecting element 100 resetting the piston trip by moving the movable surface 120 is illustrated in FIG. 1D.

FIG. 1D is a functional block diagram 163 showing the piston trip being reset through the use of the connecting element 100. The functional block diagram 163 shows the breaker handle 140 after it is moved to an off position. In the functional block diagrams 160, 161, and 162, the breaker handle 140 is not shown in the off position. Referring again to FIG. 1D, moving the breaker handle 140 to the off position causes the first component 145 mechanically linked to the breaker handle 140 to mechanically couple to the connecting element 100. In a configuration, the connecting element 100 has a first surface 101 and a second surface 102. The first component 145 mechanically linked to the breaker handle 140 mechanically couples to the connecting element 100 by contacting the first surface 101 of the connecting element 100. Similarly, the second component 125 mechanically linked to the movable surface 120 mechanically couples to the connecting element 100 by contacting the second surface 102 of the connecting element 100.

In operation of the piston trip illustrated by the functional block diagram 163, the breaker handle 140 is moved to the off position following a trip event. The movement of the breaker handle 140 to the off position can be effected by, for example, a user manipulating the breaker handle 140. In an example configuration, the movement of the breaker handle 140 causes the first component 145 to mechanically couple to the connecting element 100 by contacting the first surface 101. The contact drives the second surface 102 of the connecting element 100 to contact the second component 125 and thereby mechanically couple to the second component 125. The contact urges the second component 125 to move the movable surface 120 to the reset position through the mechanical linkage between the movable surface 120 and the second component 125. Through the mechanical coupling of the connecting element 100 to the first component 145 and the second component 125, the motion of the breaker handle 140 is linked to the motion of the movable surface 120. In a configuration, the motion of the breaker handle 140 forces the movable surface 120 to return to the first position, even when its motion is impeded by debris remaining from an arcing event. In a configuration, the motion of the breaker handle 140 provides a force to overcome an impediment on the motion of the movable surface 120.

Figure 1E:
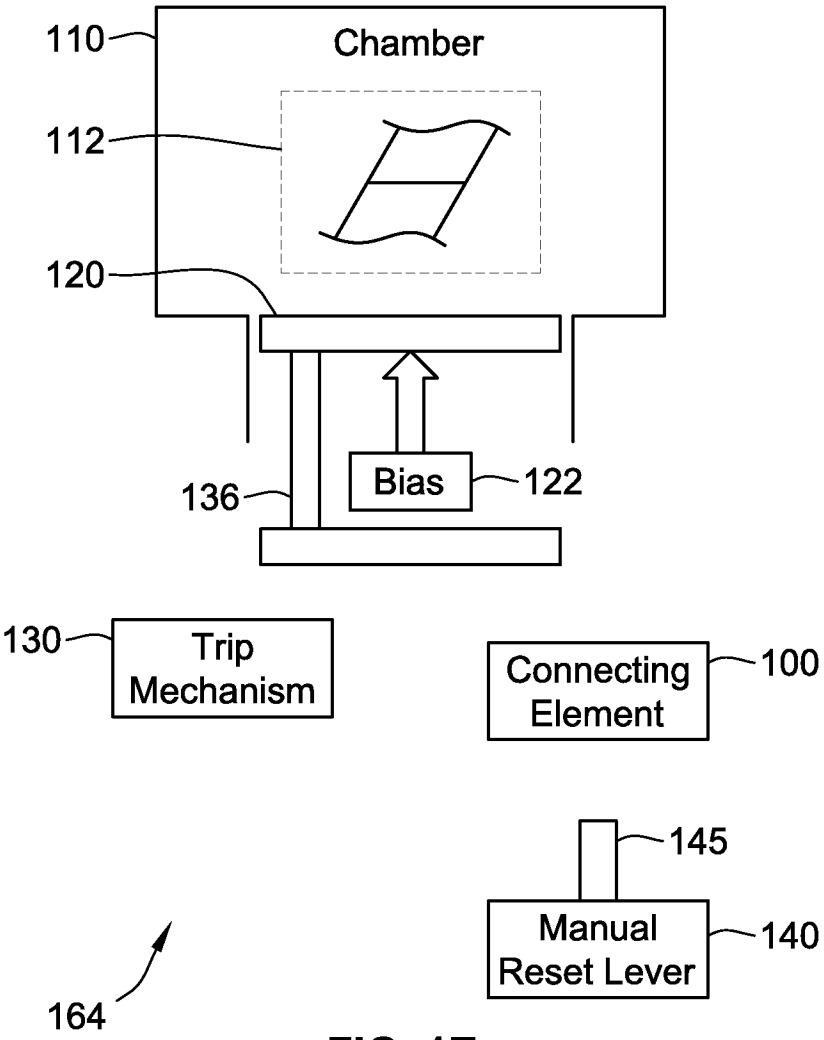
FIG. 1E is a block diagram showing a piston trip in a normal operating state incorporating an alternative design choice.

FIG. 1E is a functional block diagram 164 showing a piston trip in a normal operating state incorporating an alternative design choice. The functional block diagram 164 is similar to the block diagram 160 except that the functional block diagram 164 incorporates a single component 136 to replace the trip component 135 and the second component 125. The single component 136 is mechanically linked to the movable surface 120, but is aligned to mechanically couple to either or both of the trip mechanism 130 or the connecting element 100. In a configuration, the single component 136 can be permanently affixed to the movable surface 120 and can be integrally formed with the movable surface 120.

While a configuration of the connecting element 100 is described in which the connecting element 100 has a first surface 101 making contact with components mechanically linked to the breaker handle 140, and a second surface 102 making contact with the movable surface 120, the present disclosure is not so limited. The connecting element 100 can be a protrusion on a portion of the first component 145 mechanically linked to the breaker handle 140. Similarly, the connecting element 100 can be a protrusion on a portion of the second component 125 mechanically linked to the movable surface 120. The connecting element 100 can also be a separate component that is not permanently mechanically linked to any other components of the piston trip. For example, the connecting element 100 can operate by passively transferring a force applied to the first surface 101 of the connecting element 100 to the second surface 102 of the connecting element 100. A configuration where the connecting element 100 is a separate component can offer benefits of allowing the connecting element to be incorporated with existing hardware used in the electrical circuit breaker without necessitating redesigning any existing components. The connecting element 100 can be created from metal or plastic, and can be formed by conventional methods for creating parts to be used in an electrical circuit breaker.

The functional block diagrams illustrated in FIGS. 1A through 1E provide a symbolic representation of the operation of a piston trip in different operating states. The functional block diagrams (160, 161, 162, 163, 164) symbolically illustrate the components (100, 125, 145) used to provide a mechanical linkage between the breaker handle 140 and the movable surface 120, but the present disclosure is not limited to a particular type of component and applies to components that are levers or rods that can move both rotationally and rectilinearly in order to provide the mechanical linkage symbolically illustrated. Additionally, while the breaker handle 140 is illustrated as moving along the same direction as the direction of motion of the movable surface 120, the present disclosure applies to a breaker handles 140 that moves rotationally about a pivot and in a direction different from the direction of motion of the movable surface. The present disclosure extends to a configuration having a mechanical linkage to transfer the motion of the breaker handle 140 to the motion of the movable surface 120 through the use of a mechanical linkage including the connecting element 100. A particular implementation of the disclosed mechanical linkage for resetting a piston trip using the motion of a breaker handle is discussed below in connection with FIGS. 2A through 2D and FIGS. 3A through 3B. Elements numbered in FIGS. 2A through 2D and FIGS. 3A through 3B generally use element numbers one-hundred greater than the corresponding elements used in the functional block diagrams shown in FIGS. 1A through 1E.

Figure 2A:
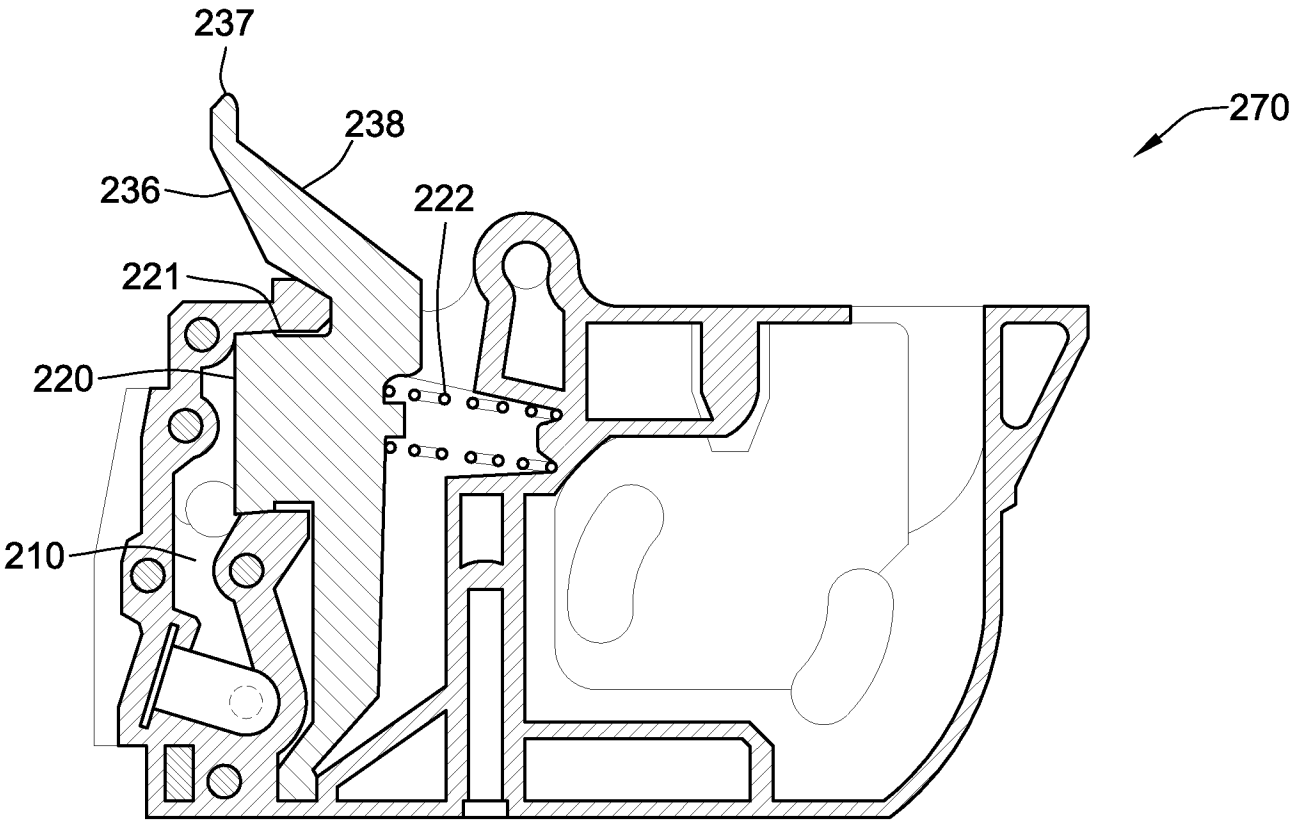
FIG. 2A is a cross-sectional view of a piston trip.
Figure 2B:
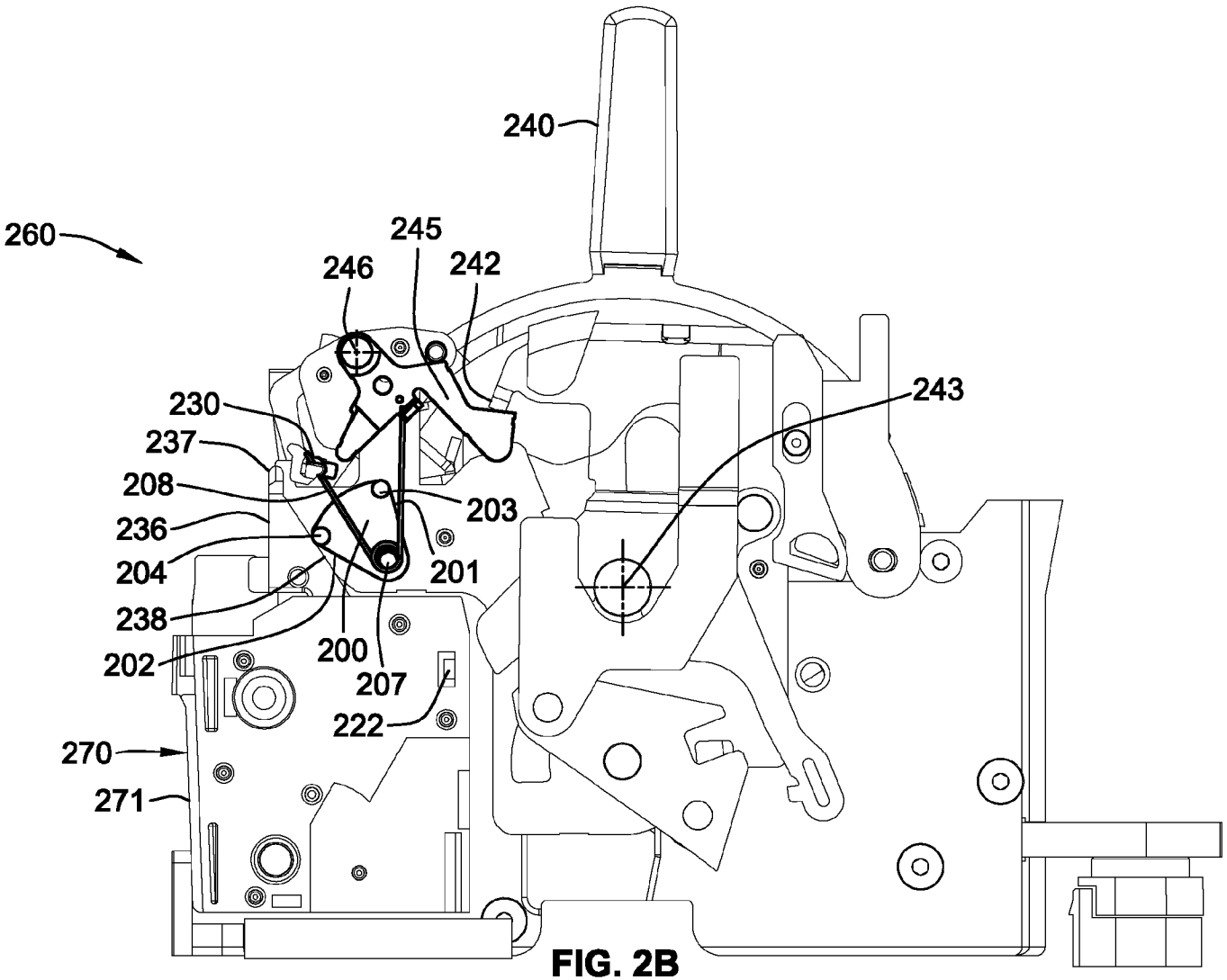
FIG. 2B illustrates a side view of an electrical circuit breaker.

FIG. 2A is a cross-sectional view of a piston trip 270. The piston trip 270 includes a chamber 210, a movable surface 220, a bias 222, and a hammer component 236 connected to the movable surface 220. In the piston trip 270, the movable surface 220 is a piston moving within a sheath 221, and the bias 222 is a spring. The piston trip 270 is also referred to as a "piston trip" mechanism. The sheath 221 can be integrally formed with the interior wall of the chamber 210. The sheath 221 is an interior surface through which the movable surface 220 can move. The movable surface 220 is shown in a first position resting within the sheath 221. The hammer component 236 is an arm extending from the piston trip 270 having a tip 237 and an angled surface 238. The tip 237 can be used to activate a trip mechanism 230 as shown in FIG. 2B. Referring to FIG. 2A, the hammer component 236 is integrally formed with the movable surface 220. The hammer component 236 provides a function similar to the function of the symbolically illustrated single component 136 in the block diagram 164 shown in FIG. 1E. Returning again to FIG. 2A, the chamber 210 is in fluid communication with a breaking unit housing a pair of electrical contacts (not shown) configured to separate when current flowing through them exceeds a threshold.

Figure 2C:
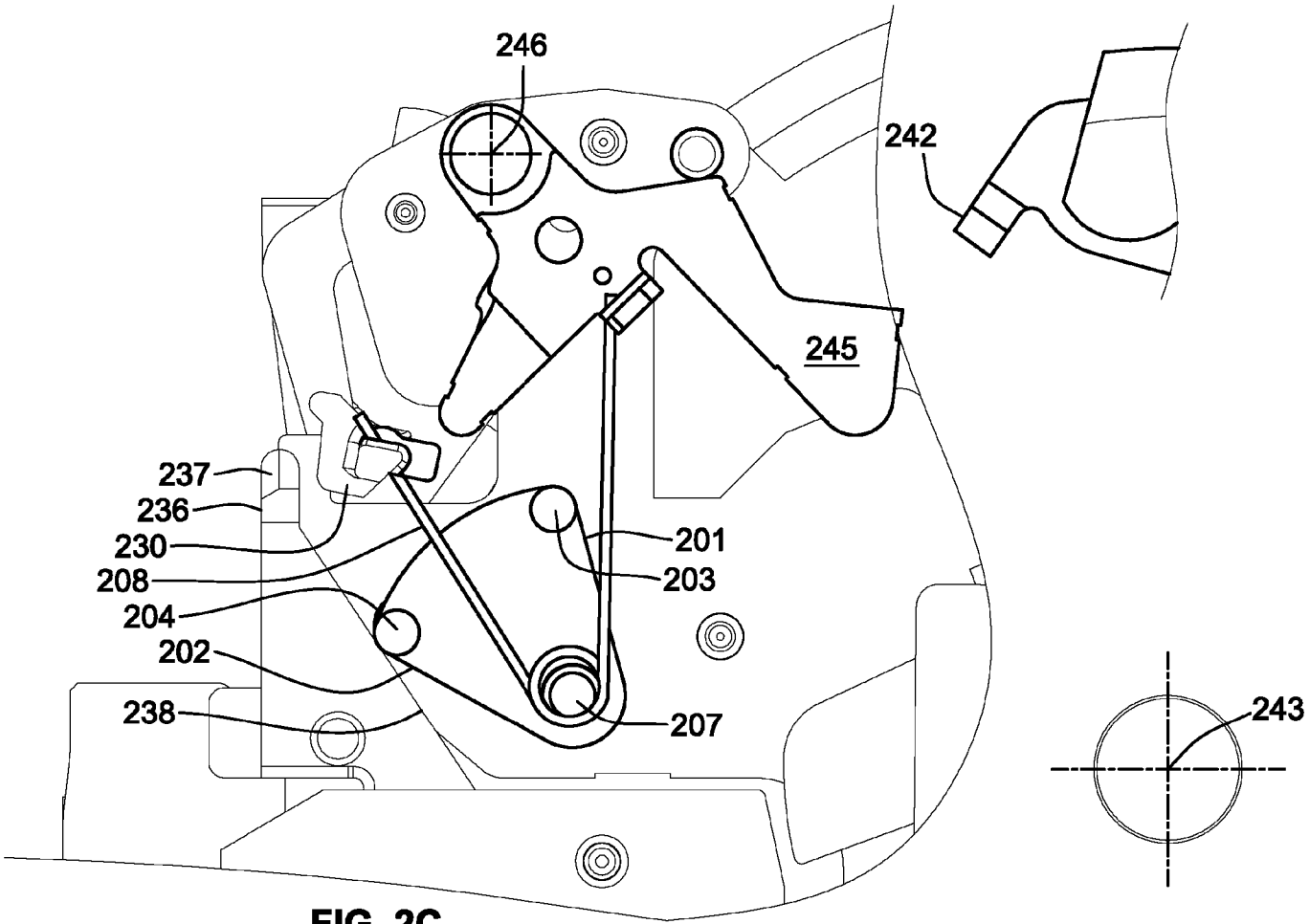
FIG. 2C shows a close view of the mechanical linkage between the breaker handle and the movable surface during a normal operating condition of the electrical circuit breaker.
Figure 2D:
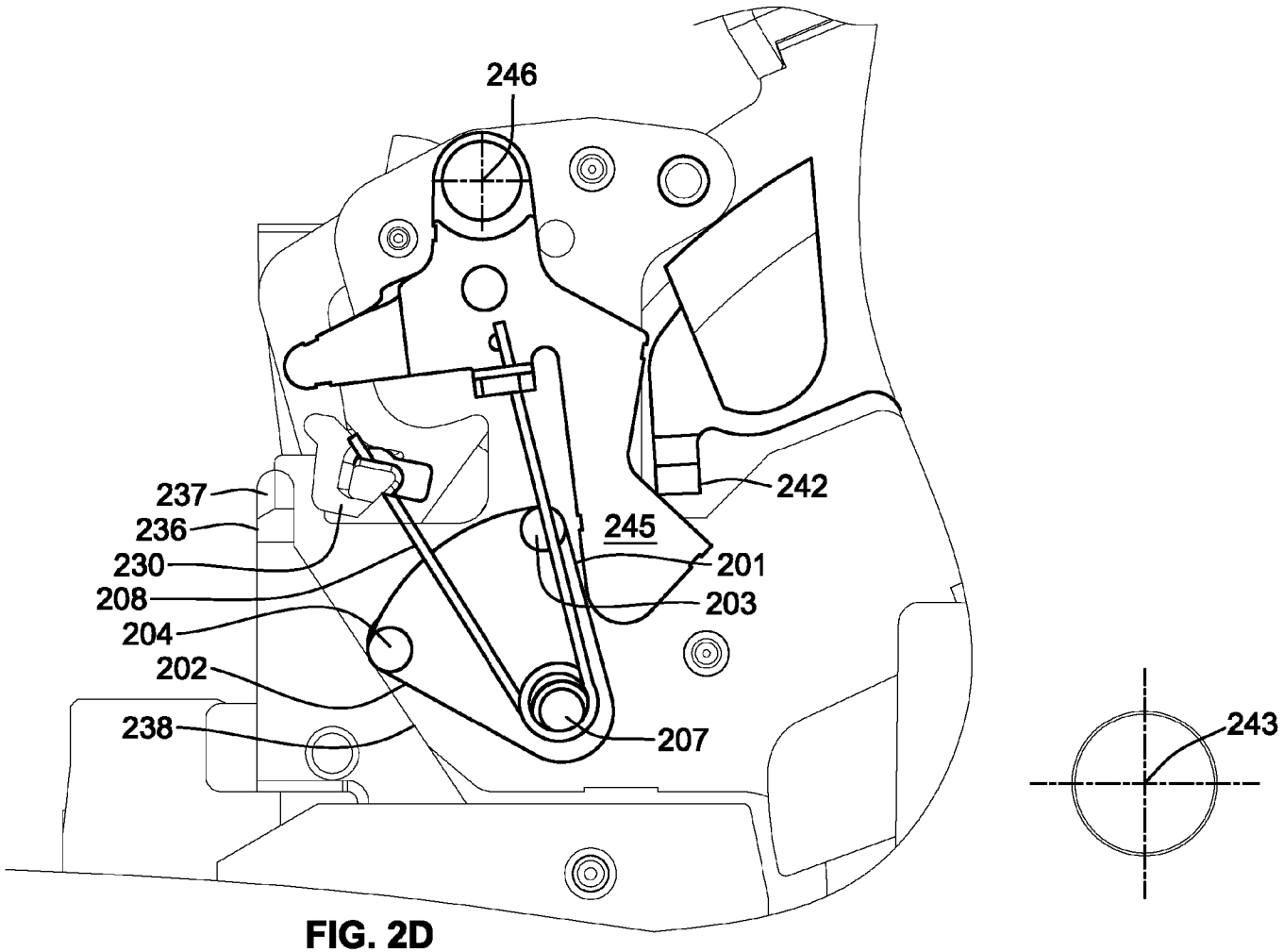
FIG. 2D shows a close view of the mechanical linkage between the breaker handle and the movable surface during a reset operation of the electrical circuit breaker.

In operation of the piston trip 270, an over current flowing through the electrical contacts causes the electrical contacts to separate and an arcing energy to be released within the breaking unit, which is in fluid communication with the chamber 210. The released arcing energy heats gas within the chamber 210 and increases the pressure within the chamber 210. The increased pressure pushes the movable surface 220 against the force of the bias 222 to a second position. The movement of the movable surface 220 causes the hammer component 236 to move and the tip 237 activates the trip mechanism 230. Activating the trip mechanism 230 trips the circuit, which halts the release of the arcing energy within the breaking unit. As the increased pressure in the chamber 210 dissipates, the movable surface 220 moves back to the first position within the sheath 221, unless the motion of the movable surface 220 is impeded by imbedded debris released during the arcing event. If the motion of the movable surface 220 is impeded, the movable surface 220 can be forced back into position by providing a mechanical linkage between a breaker handle and the movable surface 220 as illustrated in FIGS. 2B through 2D.

FIG. 2B illustrates a side view of an electrical circuit breaker 260. The electrical circuit breaker 260 includes a breaker handle 240 and a first component 245 mechanically linked to the breaker handle 240. The first component 245 is mechanically linked to the breaker handle through a cradle 242. The cradle 242 is attached to the breaker handle 240 such that both the cradle 242 and the breaker handle 240 rotate about the same pivot 243. The first component 245 rotates about a pivot 246. The electrical circuit breaker 260 further includes a connecting element 200 and the piston trip 270.

The piston trip 270 is enclosed within a cover 271. The bias 222 is visible through an opening in the cover 271. The hammer component 236 connected to the movable surface 220 extends vertically from the cover 271. The tip 237 of the hammer component 236 is positioned to activate the trip mechanism 230 by moving against the force of the bias 222. The angled surface 238 of the hammer component 236 is positioned to interface with the connecting element 200. The connecting element 200 provides a mechanical linkage between the hammer component 236 connected to the movable surface 220 and the first component 245 mechanically linked to the breaker handle 240.

In a configuration, the connecting element 200 is a lever rotating about a pivot 207. The connecting element 200 is in a generally triangular or wedge shape, with the pivot 207 proximate to one corner of the connecting element 200. The connecting element 200 has a first surface 201 and a second surface 202. The first surface 201 is oriented generally along a direction extending radially from the pivot 207. The second surface 202 is also oriented generally along a direction extending radially from the pivot 207. The first surface 201 is positioned to contact the first component 245 mechanically linked to the breaker handle 240 during movement of the breaker handle 240. The second surface 202 is positioned to contact the angled surface 238 of the hammer component 236. The connecting element 200 further includes a first nodule 203 located proximate the first surface 201 and a second nodule 204 located proximate the second surface 202. The first nodule 203 and the second nodule 204 retain the connecting element 200 in its position by interfacing with a radial feature 208. The radial feature 208 can be a portion of a spring extending from the pivot 207. The first and second nodules (203, 204) prevent the connecting element 200 from rotating in either direction past the point where the nodules (203, 204) interface with the radial feature 208. The nodules (203, 204) can also advantageously ensure that the connecting element 200 is correctly installed during assembly. The nodules (203, 204) advantageously ensure that the connecting element 200 is designed for manufacturing, because installing the connecting element 200 with the nodules (203, 204) facing inward, rather than outward, can result in the electrical circuit breaker binding during a testing operation of the breaker handle 240.

In a reset operation of the electrical circuit breaker 260, the breaker handle 240 is rotated in a counter-clockwise direction about pivot 243. The rotation of the breaker handle 240 drives the cradle 242 into the first component 245. The connection between the cradle 242 and the first component 245 urges the first component 245 to rotate clockwise about the pivot 246. The first component 245 is rotated to connect to the first surface 201 of the connecting element 200. The connection between the first component 245 and the connecting element 200 urges the connecting element 200 to rotate counter-clockwise about pivot 207. The rotation of the connecting element 200 drives the second surface 202 of the connecting element 200 to connect with the angled surface 238 of the hammer component 236, which completes the mechanical linkage between the breaker handle 240 and the movable surface 220. Continued rotation of the breaker handle 240 drives the hammer component 236 in the same direction as it is being urged by the bias 222, and moves the movable surface 220 to the first position within the sheath 221.

FIG. 2C shows a close view of the mechanical linkage between the breaker handle 240 and the movable surface 220 during a normal operating condition of the electrical circuit breaker 260. In the configuration shown in FIG. 2C, the connecting element 200 is shown resting on the angled surface 238 of the hammer component 236, but not transferring any force to the hammer component 236. The cradle 242 connected to the breaker handle 240 is shown in its ordinary operating position when the breaker handle is set to an operating position. The first component 245 is also shown in a normal operating position.

FIG. 2D shows a close view of the mechanical linkage between the breaker handle 240 and the movable surface 220 during a reset operation of the electrical circuit breaker 260. In the configuration shown in FIG. 2D, the breaker handle 240 is not visible, but is rotated counter-clockwise about the pivot 243 to an off position. The rotation of the breaker handle 240 moves the cradle 242 and drives it into the first component 245, which then rotates clockwise about the pivot 246. The first component 245 rotates to contact the first surface 201 of the connecting element 200. The connecting element 200 then rotates counter-clockwise and the second surface 202 contacts the angled surface 238 of the hammer component 236. During the reset operation of the electrical circuit breaker, the cradle 242 contacts the first component 245. The first component 245 then contacts the connecting element 200, which then contacts the hammer component 236. According to an implementation of the present disclosure, the connecting element 200 provides a mechanical linkage between the motion of the breaker handle 240 and the movable surface 220 within the piston trip 270.

Figure 3B:
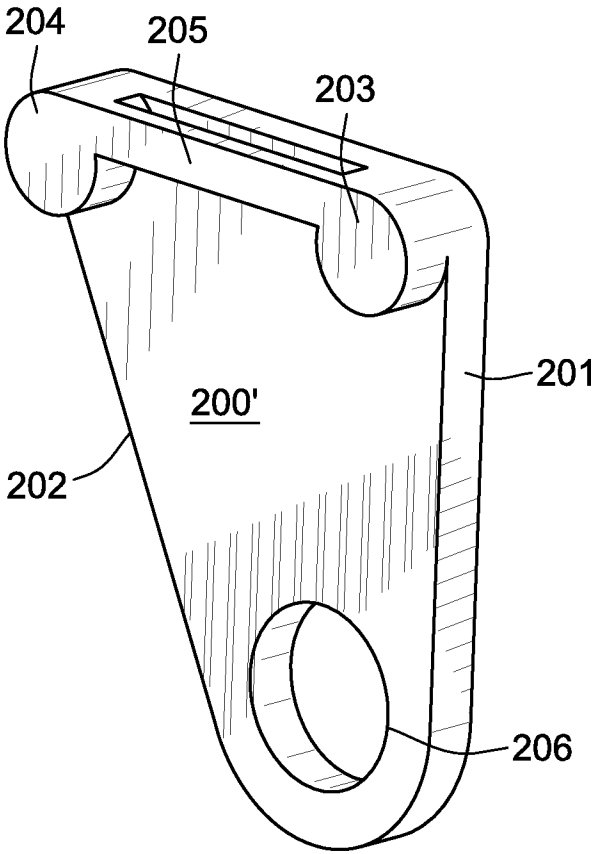
FIG. 3B provides a front aspect view of a connecting element incorporating a retaining bar.
Figure 3A:
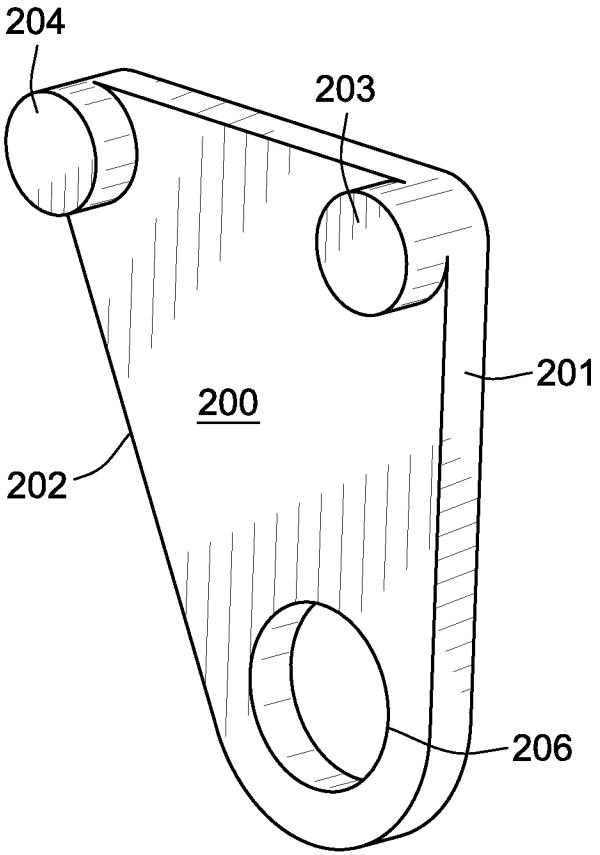
FIG. 3A provides an aspect view of the connecting element.

FIG. 3A provides an aspect view of the connecting element 200. According to an example configuration, the connecting element 200 is generally triangular or wedge shaped. The connecting element 200 has a circular hole 206 proximate to one corner for receiving a pivot. The circular hole 206 allows the connecting element 200 to pivot about a point located in the center of the circular hole 206. The connecting element 200 includes the first surface 201 and the second surface 202. The first surface 201 is a point of contact for the first component 245 mechanically linked to the breaker handle 240. The second surface 202 is a point of contact for the hammer component 236 mechanically linked to the movable surface 220. The connecting element 200 further includes the first nodule 203 and the second nodule 204. The first nodule 203 is located proximate the first surface 201, and the second nodule 204 is located proximate the second surface 202. The first nodule 203 and the second nodule 204 maintain the connecting element 200 in a desired position by interfacing with the radial feature 208 extending radially from the pivot penetrating the circular hole 206.

FIG. 3B provides a front aspect view of a connecting element 200' incorporating a retaining bar 205. The retaining bar 205 has a first end connected to the first nodule 203 and a second end connected to the second nodule 204. The retaining bar 205 thus encloses a gap formed by the retaining bar 205, the first nodule 203, the second nodule 204, and the top surface of the connecting element 200'. The gap formed by the retaining bar 205 and the first and second nodules (203, 204) can be used to retain the connecting element 200' in a desired position by interfacing with the radial feature 208 extending radially from the pivot penetrating the circular hole 206. The radial feature 208 is covered by the retaining bar 205. In an example configuration, the connecting element 200' can offer an improved ability to retain the connecting element 200' in a desired position by using the retaining bar 205 to ensure that the connecting element does not slip past the radial feature 208.

Figure 4A:
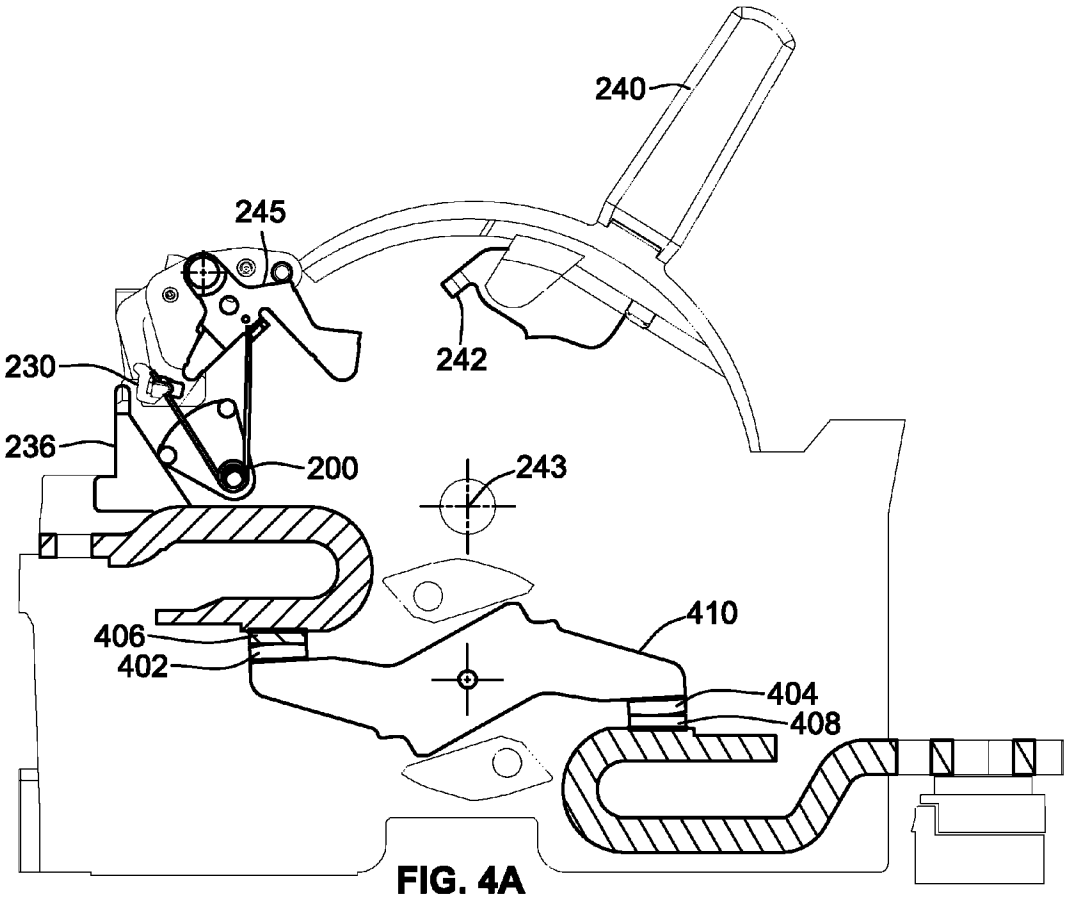
FIG. 4A illustrates a side view of a molded case circuit breaker (MCCB) in an on position.
Figure 4B:
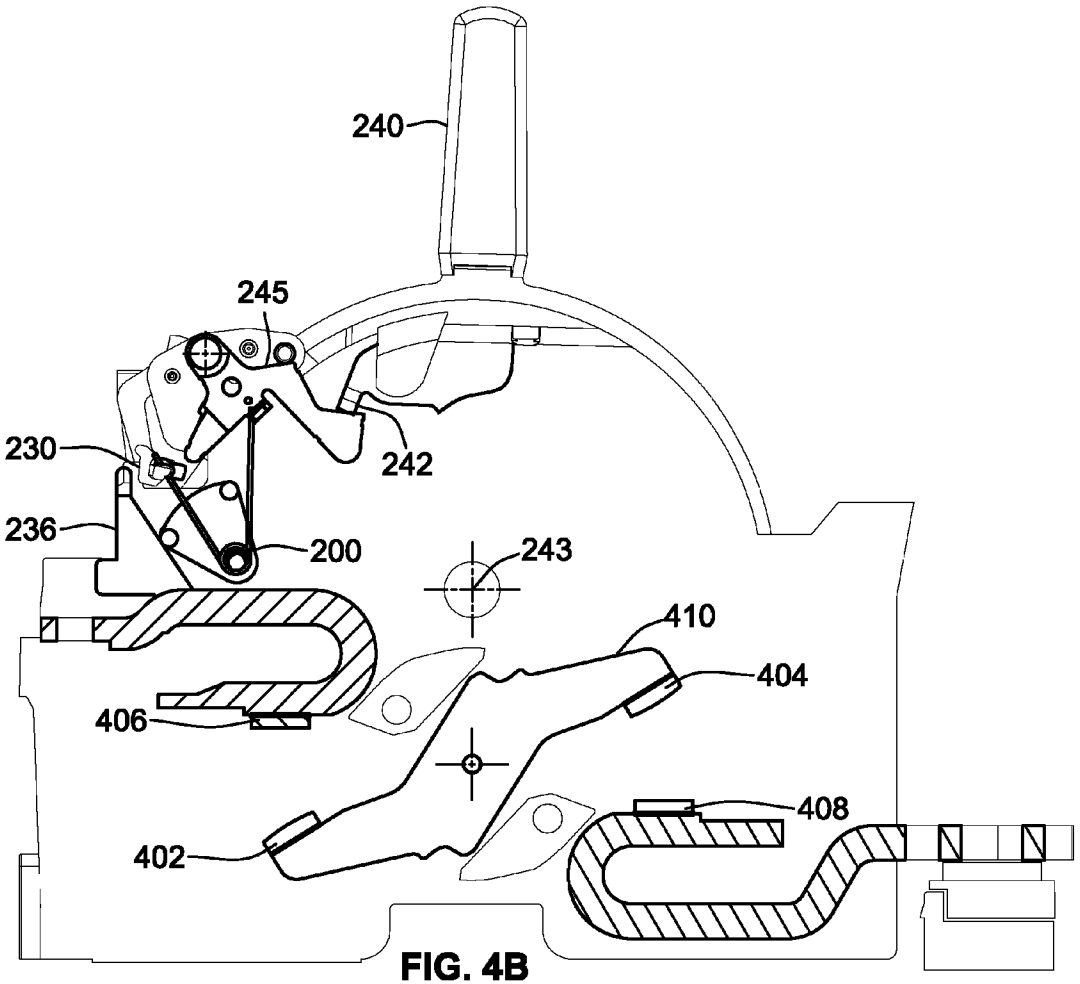
FIG. 4B illustrates a side view of the MCCB in a tripped position following an arc fault event.
Figure 4C:
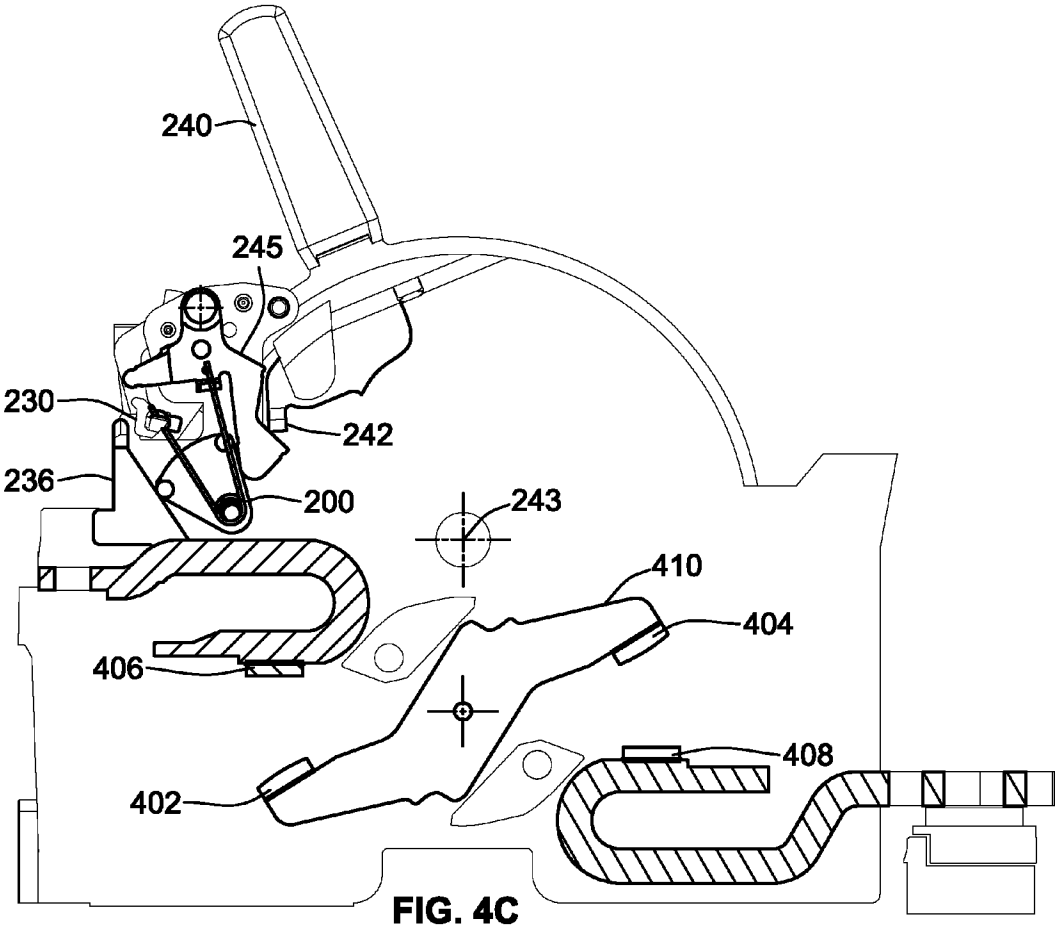
FIG. 4C illustrates a side view of the MCCB being reset with the MCCB in an off position.

FIG. 4A illustrates a side view of a molded case circuit breaker (MCCB) in an untripped operating position. The lower portion of FIG. 4A provides a cross-section view of the electrical contacts housed in the breaking unit of the MCCB. The cross-section shown in FIGS. 4A through 4C is of a different plane than the cross-section shown in FIG. 2A. Viewable in FIG. 4A is a rotatable conductor 410 having a first movable contact 402 and a second movable contact 404. The movable contacts (402, 404) are shown in electrical connection with a first stationary contact 406 and a second stationary contact 408. In the configuration shown, the stationary contacts (406, 408) are electrically connected through the rotatable conductor 410. In the configuration provided in FIG. 4A, when the MCCB is energized, current flows between the stationary contacts (406, 408), and therefore the MCCB is on. In the on position shown, the breaker handle 240 is oriented vertically, and the first component 245 is not forced to a different position as a result of contact with the cradle 242. The connecting element 200 is not being urged into the hammer component 236.

FIG. 4B illustrates a side view of the MCCB in a tripped position following an arc fault event. In the tripped position, the rotatable conductor 410 is rotated counter-clockwise responsive to a current flowing through the rotatable conductor exceeding a threshold. In the tripped position, the movable contacts (402, 404) are not in contact with the stationary contacts (406, 408) and current can no longer flow between the stationary contacts (406, 408). The separation of the movable contacts (402, 404) from the stationary contacts (406, 408) results in an arc event, which releases energy and raises the pressure inside the breaking unit. The increased pressure is communicated to the chamber 210 shown in the cross-section view in FIG. 2A through a fluid connection. Responsive to the increased pressure, the hammer component 236 is urged toward the trip mechanism 230 to activate the trip mechanism 230. FIG. 4B illustrates the position of the various components in the MCCB following the activation of the trip mechanism 230. The activation of the trip mechanism 230 causes the breaker handle 240 to move to a tripped position, which is the position shown in FIG. 4B with the breaker handle 240 rotated clockwise relative to the on position shown in FIG. 4A.

FIG. 4C illustrates a side view of the MCCB being reset with the MCCB in an off position. In FIG. 4C, the breaker handle 240 is rotated counter-clockwise relative to the tripped position shown in FIG. 4B to an off position, which is the position shown in FIG. 4C. In FIG. 4C the breaker handle 240 is urged to rotate counter-clockwise to the off position. The breaker handle 240 can be urged to the reset position by, for example, a user manually manipulating the breaker handle 240. In the off position, the movable contacts (402, 404) are not in contact with the stationary contacts (406, 408) as in FIG. 4B. Referring again to FIG. 4C, the cradle 242, which is mechanically connected to the breaker handle 240 such that the cradle 242 rotates with the breaker handle 240 about the same pivot 243, is contacting the first component 245. The contact between the cradle 242 and the first component 245 urges the first component 245 to rotate clockwise. The first component 245 is thereby urged to rotate until it contacts the connecting element 200. The connecting element 200 is then urged to rotate counter-clockwise until it contacts the hammer component 236. The hammer component 236 is thereby urged to return to its normal operating, untripped position by the contact of the connecting element 200. The connecting element 200 therefore provides a mechanical connection between the breaker handle 240 and the hammer component 236 mechanically connected to the movable surface within the piston trip within the MCCB. In operation of the MCCB, following the manipulation of the breaker handle 240 to the reset position, the breaker handle 240 can return to the untripped position shown in FIG. 4A.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. An electrical circuit breaker comprising:

a breaker handle for resetting a trip mechanism, the trip mechanism being reset responsive to the breaker handle being moved to an off position;

a pair of electrical contacts housed within a first chamber, the pair of electrical contacts configured to separate responsive to a current flowing through the contacts exceeding a threshold;

a movable surface biased to a first position, the movable surface defining an inner boundary of a portion of the first chamber, the movable surface being moved to a second position responsive to a pressure in the first chamber, the first chamber having a larger volume responsive to the movable surface being in the second position than responsive to the movable surface being in the first position; and a connecting element having a first surface and a second surface, the first surface mechanically contacting a first component responsive to the breaker handle moving to the off position, the second surface mechanically contacting a second component responsive to the breaker handle moving to the off position, the first component being mechanically linked to the breaker handle, the second component being mechanically linked to the movable surface, wherein the moveable surface is forced to the first position by the second surface mechanically contacting the second component responsive to the breaker handle moving to the off position.

2. The electrical circuit breaker of claim 1, wherein moving the breaker handle moves the movable surface to the first position through a mechanical linkage that includes the connecting element.

3. The electrical circuit breaker of claim 1, wherein the first component and second component are aligned such that responsive to moving the breaker handle to the off position, the breaker handle, or a component mechanically linked to the breaker handle, contacts the first component and causes the first component to move, the first component being aligned to contact the connecting element and cause the connecting element to move, the connecting element being aligned to contact the second component and cause the second component to move, the second component aligned to cause the movable surface to move to the first position.

4. The electrical circuit breaker of claim 1, wherein the connecting element is removably connected to either the first component or the second component.

5. The electrical circuit breaker of claim 1, wherein the connecting element is a lever configured to rotate about a pivot and wherein the first surface is a surface of the lever oriented along a direction extending radially from the pivot, and wherein the second surface is another surface of the lever oriented along a direction extending radially from the pivot.

6. The electrical circuit breaker of claim 5, wherein the lever includes a first nodule proximate the first surface and a second nodule proximate the second surface, the first nodule and the second nodule configured to interface with a radial feature, the radial feature extending radially from the pivot, wherein the first nodule and the second nodule retain the lever by interfacing with the radial feature.

7. The electrical circuit breaker of claim 5, wherein the lever includes a retaining bar, the retaining bar having a first end attached to a first nodule proximate the first surface and a second end attached to a second nodule proximate the second surface, the retaining bar, the first nodule, and the second nodule configured to interface with a radial feature, the radial feature extending radially from the pivot, the retaining bar, the first nodule, and the second nodule retaining the lever by interfacing with the radial feature.

8. An apparatus for resetting a piston trip, the apparatus comprising:

a breaker handle for resetting a trip mechanism, the breaker handle movable from a tripped position to an off position;

a movable surface defining a portion of an interior surface of a first chamber housed in the piston trip, the first chamber housing a pair of electrical contacts configured to separate responsive to a current flowing through the pair of electrical contacts exceeding a threshold, the movable surface maintained in a first position by a biasing force, the movable surface movable to a second position responsive to a pressure within the first chamber overcoming the biasing force; and a connecting element for linking the movement of the breaker handle from the tripped position to the off position to the movement of the movable surface from the second position to the first position, the connecting element contacting the breaker handle when the breaker handle is moved to the off position and the contacting element causing contact to move the moveable surface to the first position when the breaker handle is moved to the off position.

9. The apparatus of claim 8, wherein moving the breaker handle from the tripped position to the off position moves the movable surface to the first position through a mechanical linkage including the connecting element.

10. The apparatus of claim 8, wherein the connecting element has a first surface and a second surface, and wherein moving the breaker handle to the off position moves a first component mechanically linked to the breaker handle such that the first component contacts the first surface of the connecting element and the second surface of the connecting element contacts a second component mechanically linked to the movable surface.

11. The apparatus of claim 10, wherein moving the breaker handle to the off position moves the first component such that:

the first component contacts the first surface of the connecting element and moves the connecting element;

the second surface of the connecting element contacts the second component and moves the second component; and the second component moves the movable surface to the first position.

12. The apparatus of claim 8, wherein the connecting element is a lever configured to rotate about a pivot.

13. The apparatus of claim 12, wherein the lever includes a first nodule and a second nodule, the first nodule located proximate the first surface, the second nodule located proximate the second surface, the first nodule and the second nodule configured to interface with a radial feature, the radial feature extending radially from the pivot, wherein the first nodule and the second nodule retain the lever by interfacing with the radial feature.

14. The apparatus of claim 12, wherein the lever includes a retaining bar attached at a first end to a first nodule and attached at second end to a second nodule, wherein the first nodule is located proximate to the first surface and the second nodule is located proximate to the second surface, the retaining bar, the first nodule, and the second nodule retaining the lever by interfacing with a radial feature extending radially from the pivot.

15. The apparatus of claim 8, wherein the connecting element is a protrusion from the manual handle or from a first component mechanically linked to the manual handle, the protrusion mechanically coupled to the movable surface or with a second component mechanically linked to the movable surface responsive to the breaker handle being moved to the off position.

16. The apparatus of claim 8, wherein the connecting element is a protrusion from the movable surface or from a second component mechanically linked to the movable surface, the protrusion mechanically coupled to the breaker handle or with a first component mechanically linked to the manual handle responsive to the breaker handle being moved to the off position.

17. An electrical circuit breaker comprising:

a breaker handle for resetting a trip mechanism;

a pair of electrical contacts within a first chamber, the pair of electrical contacts configured to separate responsive to a current flowing through the pair of electrical contacts exceeding a threshold;

a movable surface biased to a first position, the movable surface defining an inner boundary of a portion of the first chamber, the movable surface being moved to a second position in response to a pressure in the first chamber caused by an arc event between the pair of electrical contacts, the first chamber having a larger volume responsive to the movable surface being in the second position than responsive to the movable surface being in the first position; and a connecting lever having a first surface and a second surface, the connecting lever being configured to rotate about a pivot, the first surface contacting a first component mechanically linked to the manual handle responsive to the breaker handle being moved to an off position, the second end contacting a second component mechanically linked to the movable surface responsive to the breaker handle being moved to the off position to force the movable surface to the first position when the breaker handle is moved to the off position.

* * * * *